United States Patent [19]

Gentili

[11] Patent Number: 4,609,106

[45] Date of Patent: Sep. 2, 1986

[54] PORTABLE JERRICAN-LIKE CONTAINER HAVING A SUITABLE-TO-BE-PALLETIZED CASING

[76] Inventor: Vittorio Gentili, Via Caprarie 3, 40124 Bologna, Italy

[21] Appl. No.: 663,999

[22] Filed: Oct. 23, 1984

[30] Foreign Application Priority Data

Nov. 22, 1983 [IT] Italy ..... 5081/83[U]
Dec. 16, 1983 [IT] Italy ..... 5130/83[U]

[51] Int. Cl.[4] ..... B65D 21/02; B65D 1/02

[52] U.S. Cl. ..... 206/509; D9/408; D9/411; 215/1 C; 215/10; 220/72

[58] Field of Search ..... 215/1 C, 10; 220/72; 206/509; D9/408, 411

[56] References Cited

U.S. PATENT DOCUMENTS

| | | | |
|---|---|---|---|
| 2,960,248 | 11/1960 | Kuhlman . | |
| 3,369,658 | 2/1968 | Hasselmann . | |
| 3,474,843 | 10/1969 | Maris . | |
| 3,552,599 | 1/1971 | Redding | 220/72 |
| 3,558,001 | 1/1971 | Fritz | 220/72 |
| 3,616,943 | 11/1971 | Brink . | |
| 3,828,927 | 8/1974 | Schoeller . | |
| 3,889,834 | 6/1975 | Harris, Jr. . | |
| 3,940,002 | 2/1976 | Schiemann | 215/1 C |
| 4,308,955 | 1/1982 | Schieser et al. . | |

FOREIGN PATENT DOCUMENTS

| | | | |
|---|---|---|---|
| 106722 | 7/1967 | Denmark | 215/10 |
| 2550752 | 11/1975 | Fed. Rep. of Germany . | |
| 107502 | 9/1965 | Norway | 215/10 |
| 979873 | 1/1965 | United Kingdom . | |
| 1145220 | 3/1969 | United Kingdom . | |
| 1194445 | 6/1970 | United Kingdom . | |

*Primary Examiner*—George E. Lowrance
*Attorney, Agent, or Firm*—Laff, Whitesel, Conte & Saret

[57] ABSTRACT

A portable jerrican-like container having a casing suitable to be palletized by engagement into other casings particularly adapted for transporting liquids or powders.

Said container is provided with a supporting handle on its upper face and is in the form of a parallelepiped in which the length is multiple of the width; the upper and lower faces are provided with perfectly matching projections and cavities which allow a mutual engagement between superimposed containers, even when they are turned through 90°. The handle itself is part of said projections.

4 Claims, 6 Drawing Figures

PORTABLE JERRICAN-LIKE CONTAINER HAVING A SUITABLE-TO-BE-PALLETIZED CASING

BACKGROUND OF THE INVENTION

The present invention relates to a portable jerrican-like container having a casing suitable to be palletized by engagement into other casings and particularly to a portable container adapted for transporting liquids and powders.

DESCRIPTION OF THE PRIOR ART

It is known that there are at present different kinds of portable jerrican-like containers having the most different shapes. These containers are usually provided with a casing directly standing on the ground, a supporting handle, as well as an inlet and outlet opening which can be engaged by a plug or the like.

These containers can be, relative to their shape, very handy and satisfactory during their use if they are taken one by one. However they are in most cases unsatisfactory and not very handy when they are treated by groups, for example during the storing and transport operations. In fact, in most containers of the portable type presently in use casings are not suitable to be assembled and compacted so that they may occupy a small room if disposed in layers. And even if these containers can be disposed tightly close to one another by virtue of the fact that they have a squared up pattern (as in the case of common jerricans), the groups thus formed appear unstable and it is easy to disarrange them as they are not in engagement into one another. In most cases it is therefore necessary to provide additional wrappers in which containers can be assembled for transport or storing. These additional wrappers can consist of simple cardboard boxes or of plastic material sheets, in particular sheets of thermo-shrinkable plastics. Therefore, the necessity to arrange these additional wrappers and to associate said containers therewith involved a remarkable increase in prices as well as a slowing down in the distribution operations.

There are also containers provided or not with mutually engaging elements, as described in U.S. Pat. Nos. 3,474,843 and 2,960,248, but in these disclosures the stacking by engagement only takes place in a vertical direction and no grip handles allowing to handle the containers are provided.

It is the same in U.S. Pat. No. 3,889,834 where the containers' casings are provided with vertical projections and cavities adapted to get engaged into each other by superimposing the same casings in a laid down position and only on horizontal or vertical planes; however said containers must be disposed parallel to one another and no offset superimposition is possible; furthermore they do not have a grip handle.

The disclosures illustrated in U.S. Pat. Nos. 3,369,658 and 4,308,955 have the same drawbacks.

In patent No. DE-2 550 752 jerrican-like containers are described which are provided with a projecting grip handle and a projecting plug; however they are not adapted to get mutually engaged and when they need to be stacked it is used an additional element acting as a support and allowing only a vertical stacking of several superimposed jerricans.

Finally, box-shaped containers opened at the top or provided with a closing cover are known, as illustrated in U.S. Pat. Nos. 3,828,927 or 3,616,943; they are provided with mutually engaging projections allowing a superimposed or offset stacking but they can only be used to contain loose objects of different kinds.

SUMMARY OF THE INVENTION

In view of the situation, it is therefore a general object of the present invention to provide a portable jerrican-like container the casing of which can be easily and firmly engaged with adjacent containers' casings so that further steps aiming at assembling said casings, for example using additional boxes or wrapping plastics sheets, becoming unnecessary.

Within the scope of this general object it is a further important object of the present invention to provide a portable jerrican-like container the casing of which has a grip handle so shaped and disposed that it allows a stratification of several identical containers disposed even offset or turned by 90° with respect to each other and in which each layer is firmly engaged with the underneath layers in order to define compact blocks suitable to be treated as individual units.

A further object of the present invention is to provide a portable jerrican-like container of easy construction and handy use as well as complete of all its elements, so that the same can be used just as it is.

A still further object of the present invention is to provide a portable jerrican-like container particularly designed to reduce the transverse deformations due to the load of several stacked coantainers.

The foregoing objects and other objects that will become more apparent in the following are substantially attained by a portable jerrican-like container having a suitable-to-be-palletized casing of the kind directly standing on the ground and provided with a grip handle and an inlet/outlet opening that may be associated with a closing element, wherein said casing is substantially in the form of a parallelepiped in which the length is multiple of the width and the height is preferably equal to, multiple or submultiple or the width, where at least the upper and lower faces of the casing itself define flat surfaces interrupted by perfectly matching projections and cavities so that they allow the mutual engagement between superimposed containers and where the handle projects too and is so shaped that it is itself part of the above mentioned projections.

Advantageously said projections are also designed in order to allow a superimposition of the containers when they are disposed at 90° with respect to each other.

BRIEF DESCRIPTION OF THE DRAWINGS

Further features and advantages of the invention will become more apparent from the detailed description of a preferred but not exclusive embodiment thereof, given hereinafter by way of example only, with reference to the accompanying drawings, in which.

DESCRIPTION OF THE PREFERRED EMBODIMENT

Figure 1:
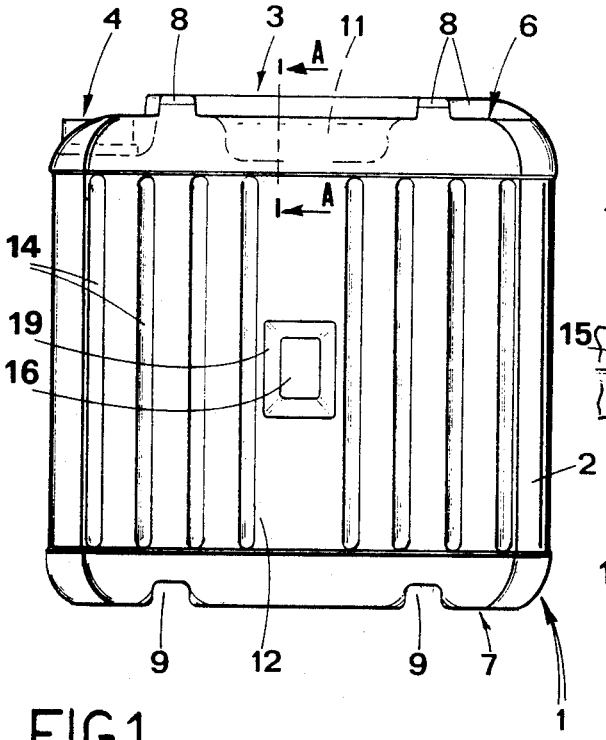
FIG. 1 is a side view of the container of the invention.

Referring to the drawings, the portable jerrican-like containers of the present invention is globally indicated at 1. It comprises, in known manner, a casing 2, a handle 3 of one piece construction with said casing, and an outlet/inlet opening which can be engaged by a closing element or plug not shown.

Originally, the portable container 1, according to the invention, has a parallelepiped-shaped casing provided with rounded edges in which the length is substantially multiple of the width. It is particularly preferred that the length is substantially twice the width.

Always according to the embodiment shown in FIG. 1 the height can be whatever, but once it has been selected it must be constant for all containers.

It is also provided that the upper and lower faces of casing 2, indicated at 6 and 7 respectively, define substantially flat surfaces interrupted by projections 8 also including the structure of the handle and by cavities 9 fitted for accommodating said projections.

Projections and cavities 8 and 9 perfectly match one another and the lower face 3 of casing 2 defines a substantially continuous base.

Figure 2:
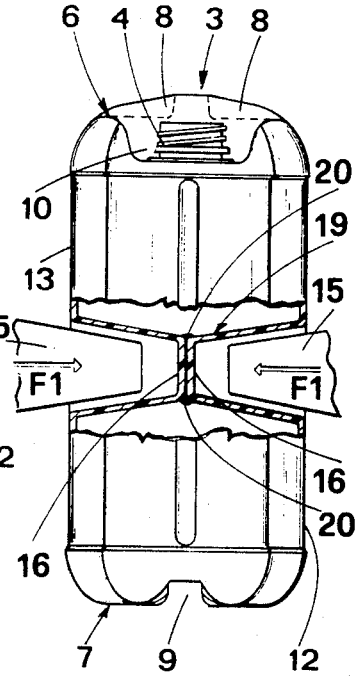
FIG. 2 is a view of the same container as shown in FIG. 1 but seen in profile from the plug and partially in vertical section.
Figure 3:
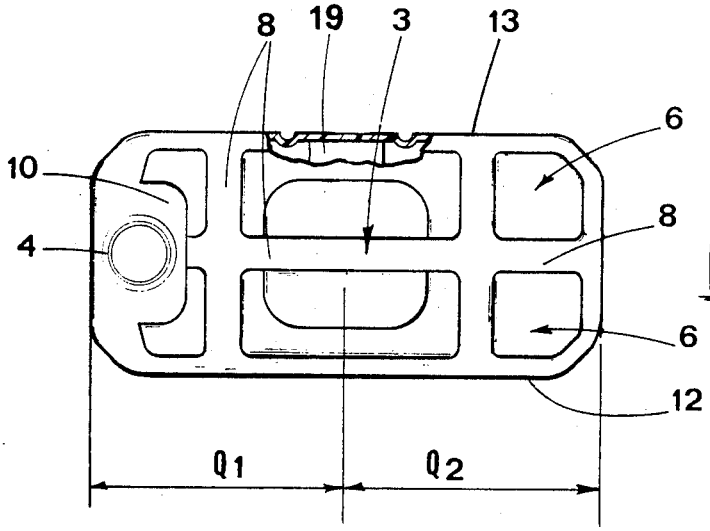
FIGS. 3 and 4 are a plan view from the top and the bottom respectively of the container seen in the preceding figures.
Figure 4:
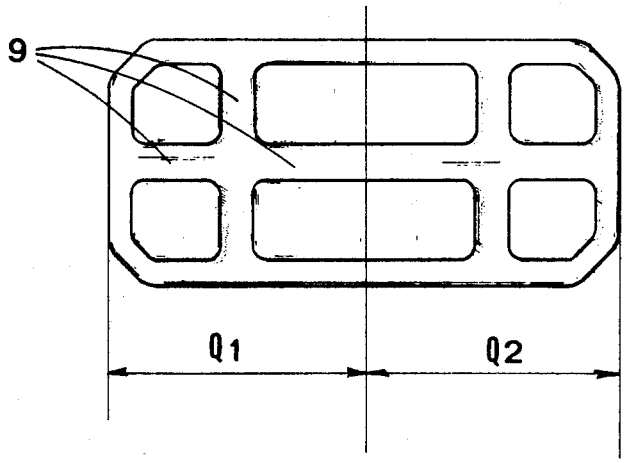
Figure 5:
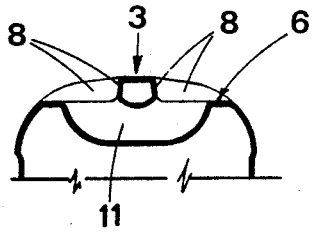
FIG. 5 is a section of the container taken along line A—A in FIG. 1.

Furthermore it is advantageously and originally provided that on each square portion $Q_1$ and $Q_2$ of faces 6 and 7 the projections and cavities 8 and 9 are identically repeated and arranged there so that a superimposition of containers is possible even if the casings 2 are rotated by 90°.

the handle 3 and opening 4 are obtained on the upper face 6 and the opening 4 is disposed in a recessed portion thereof. In fact, as seen in FIG. 2, the opening 4 projects from a recessed portion 10 of the upper face 6. The handle 3 projects from the upper face 6 (see FIGS. 1 and 2) being itself, as already said, part of the projections 8 defining the structure of said handle. As shown in FIGS. 3 and 5, the upper surface 6 is provided, in the region corresponding to the intermediate handle portion, with a recessed zone 11 allowing the holding of handle 3.

As seen from the annexed figures, projections 8 and cavities 9 have a longitudinal centre extension along the maximal dimensions of faces 6, 7 and a transverse centre extension along each square portion $Q_1$, $Q_2$ thereof. Obviously projections 8 and cavities 9 can take any shape, also different from the one shown in the figures, provided that the above described conditions are observed.

The use of the container according to the present invention is as follows.

In case of individual use, container 1 does not differ from traditional containers as it is provided with a handle and an inlet/outlet opening as the latter. On the contrary, when container 1 is associated with other containers for transport or storing by groups, its structure allows a completely different use.

Figure 6:
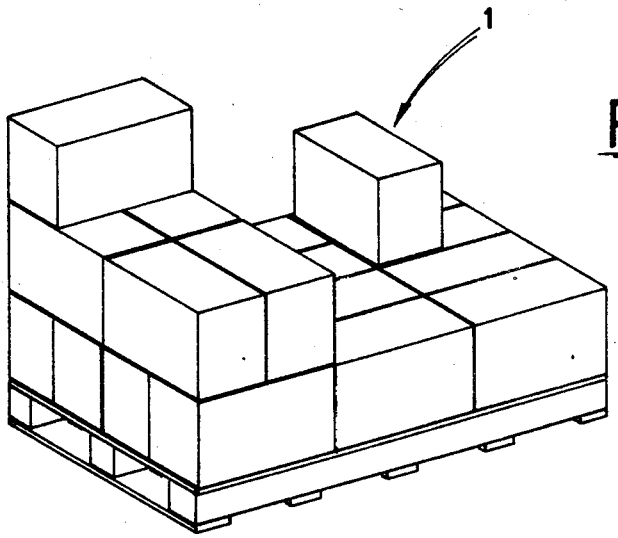
FIG. 6 diagrammatically shows a possible assembling pattern of a number of containers of the kind shown in the preceding figures.

In fact, due to the above described technical solutions, each container can be disposed in engagement with the underneath containers in order to define perfectly steady stacks. Furthermore, each container can be disposed transversely with respect to the underneath containers and for example be in engagement with two of them. As a result, all containers arranged so as to form a layer are linked together by their engagement with the containers forming the layer placed thereon. So, as shown in FIG. 6, several layers can be formed which give rise to a compact transport unit, adapted to be treated as an individual element in every respect.

Therefore, it is no more necessary to use additional boxes and wrappers in order to make the groups of containers compact and transportable. On the contrary, the jerrican-like container according to the invention allows assembling of containers of any size and therefore they always fulfill the specific transport or storing requirements.

Advantageously said jerrican-like container also has at least two side walls 12 and 13 provided with a series of inwardly extending grooves (see FIGS. 1, 2 and 3) which form as many stiffening and strengthening ribs to make the containers more resistant to vertical loads and avoid the outward swelling of said walls when submitted to a load. Grooves 14 extend in height almost over the whole width of walls 12 and 13 and are parallel to each other and spaced apart by adjacent portions coplanar of the outer surface of said walls. In this way it is possible to apply labels or bands on walls 12 and 13 in order to indicate the product contained in the jerricans, without any limitation as to the sizes of the same.

In order to ensure the best resistance to the outward swelling of the side walls 12 and 13, according to the present invention, during the moulding step of the container 1, which step is carried out by introducing and closing a tube made of plastic material (usually called "parison") between two molds and by blowing air into it, at least two sightly conical facing elements 15 are approached to each other at the inside of the mold.

As shown in FIG. 2, the conical elements 15 are caused to advance at right angles to the largest faces 12 and 13 of the container, till the areas 16 of these faces contact each other and join.

This junction can be obtained by virtue of the plasticity of the material of which the casing is made which also allows the introduction, in the direction of the arrow F, of the cores 15 at the inside of the primary cylindrical surface of the parison.

The junction of the areas 16 by "plastic welding" of the material accomplishes the creation of a tie rod 19 extending transversely to the jerrican itself, at the inside of the same, and joining the two largest walls thereof which are the most subjected to the swelling phenomenon.

In order to reduce to a minimum the possibilities that this phenomenom may occur, it is provided that, when the introduction of the cores 15 takes place, the front walls of the same are moved towards each other until they reach a shorter distance than twice the thickness of the tube, so that an upsetting area 20 can be obtained: this area is bigger if the conicity of the cores 15 is lesser, in order to make the tie rod 19 as rectilinear as possible, and therefore to reduce its possibilities of elongation, which would promote the outward swelling of the container.

If necessary, the welding area 16 can be provided with holes for the passage of additional securing or supporting elements.

Only one tie rod 19 has been shown in the figures but it is evident that the number, position and shape of the tie rods 19 depends upon the container sizes.

Finally, the container 1 has been shown in the figures as being in the form of a parallelepiped but it can practically take any desired form without diminishing the scope of the invention.

This process can be carried out even if the containers 1 are made of metal: in this case the conical elements 15 can be some electrodes.

Obviously modifications and/or improvements are possible without departing from the purview of the invention as set forth in the appended claims.

What is claimed is:

1. A portable jerrican-like container having upper and lower faces, a support handle provided on at least one of the faces, an inlet/outlet opening, said container being substantially in a form of a parallelepiped in which the length is multiple of the width and the height is preferably equal to, multiple or submultiple of the width, said upper and lower faces of the casing being flat surfaces with predetermined cavities defined in one face and predetermined matching projections defined in the other face to provide mutual engagement between superimposed containers; said projections and cavities being identically repeated on each square portion of said lower and upper faces and being formed and sized to allow a number of containers to be superimposed and stacked on one another with the projections of one container protruding into the cavities of another container when said containers are at 90° and 180° to each other and said handle being a part of said projections.

2. A portable container according to claim 1, wherein said projections and cavities have a longitudinal centre extension along the maximal dimension of said upper and lower faces and a transverse centre extension along each square portion of same.

3. A portable container according to claim 1, wherein said projections and handle are obtained on said upper face and wherein said cavities are obtained on said lower face, the latter defining a substantially continuous base surface.

4. A portable container according to claim 3, wherein said projections and cavities have a longitudinal centre extension along the maximal dimension of said upper and lower faces and a transverse centre extension along each square portion of same.

* * * * *